US010189047B2

(12) United States Patent
Govyadinov et al.

(10) Patent No.: US 10,189,047 B2
(45) Date of Patent: Jan. 29, 2019

(54) FLUID EJECTION APPARATUS WITH FLUID SUPPLY FLOOR FILTER

(71) Applicant: Hewlett-Packard Development Company, L.P., Houston, TX (US)

(72) Inventors: Alexander N. Govyadinov, Corvallis, OR (US); Paul A. Richards, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/870,843

(22) Filed: Jan. 12, 2018

(65) Prior Publication Data

US 2018/0133746 A1 May 17, 2018

Related U.S. Application Data

(63) Continuation of application No. 14/928,357, filed on Oct. 30, 2015, now Pat. No. 9,901,952, which is a (Continued)

(51) Int. Cl.

| | |
|---|---|
| ***B05C 5/02*** | (2006.01) |
| ***B41J 2/175*** | (2006.01) |
| ***B41J 2/14*** | (2006.01) |

(52) U.S. Cl.

CPC ..... *B05C 5/02* (2013.01); *B41J 2/1404* (2013.01); *B41J 2/14201* (2013.01); *B41J 2/175* (2013.01);

(Continued)

(58) Field of Classification Search

CPC .. B05C 5/02; B41J 2/175; B41J 2/1404; B41J 2/14201; B41J 2/17563; B41J 2/17596;

(Continued)

(56) References Cited

U.S. PATENT DOCUMENTS 6,132,033 A 10/2000 Browning
6,244,694 B1 * 6/2001 Weber ..... B41J 2/055 347/65

(Continued)

FOREIGN PATENT DOCUMENTS

CN 2652657 11/2004
JP 2007112099 5/2007

(Continued)

OTHER PUBLICATIONS

Inkjet Printheads,http://mindmachine.co.uk/book/print_42_inkjet_heads.html.

(Continued)

*Primary Examiner* — Henok Legesse
(74) *Attorney, Agent, or Firm* — HP Inc—Patent Department

(57) ABSTRACT

The examples provide a fluid ejection apparatus that includes a fluid slot; a passage, a drop generator and a fluid circulation pump. The passage has an inlet connected to the fluid slot and an outlet spaced from the inlet and connected to the fluid slot. The passage as a first portion extending in a first direction from the inlet and a second portion extending from the first portion to the outlet in a second direction, opposite to the first direction. A filter is within the fluid slot across the inlet.

20 Claims, 11 Drawing Sheets

Related U.S. Application Data continuation of application No. 14/397,481, filed as application No. PCT/US2012/045439 on Jul. 3, 2012, now Pat. No. 9,283,590.

(52) U.S. Cl.
CPC ..... *B41J 2/17563* (2013.01); *B41J 2/17596* (2013.01); *B41J 2002/14403* (2013.01); *B41J 2002/14467* (2013.01); *B41J 2202/12* (2013.01)

(58) Field of Classification Search
CPC ..... B41J 2002/14403; B41J 2202/12; B41J 2002/14467
See application file for complete search history.

(56) References Cited

U.S. PATENT DOCUMENTS

| | | | | |
|---|---|---|---|---|
| 6,264,309 | B1 | 7/2001 | Sullivan | |
| 6,626,522 | B2 * | 9/2003 | Rapp | B41J 2/1404 347/65 |
| 7,377,629 | B2 * | 5/2008 | Kobayashi | B41J 2/1404 347/56 |
| 7,967,414 | B2 | 6/2011 | Schmitt | |
| 8,119,019 | B2 | 2/2012 | Silverbrook | |
| 8,540,355 | B2 | 9/2013 | Govyadinov et al. | |
| 8,562,119 | B2 | 10/2013 | Xie et al. | |
| 8,939,531 | B2 * | 1/2015 | Govyadinov | B41J 2/14129 347/9 |
| 9,090,084 | B2 * | 7/2015 | Govyadinov | B41J 2/1404 |
| 9,156,262 | B2 * | 10/2015 | Taff | B41J 2/1404 |
| 9,283,590 | B2 * | 3/2016 | Govyadinov | B41J 2/175 |
| 9,901,952 | B2 * | 2/2018 | Govyadinov | B05C 5/02 |
| 2003/0048333 | A1 | 3/2003 | Rapp | |
| 2005/0062817 | A1 | 3/2005 | Steed et al. | |
| 2006/0023029 | A1 | 2/2006 | Mataki | |
| 2006/0044353 | A1 * | 3/2006 | Kobayashi | B41J 2/1404 347/54 |
| 2009/0040249 | A1 | 2/2009 | Wouters et al. | |
| 2011/0286493 | A1 | 11/2011 | Torniainen | |
| 2012/0007921 | A1 | 1/2012 | Govyadinov et al. | |
| 2012/0092421 | A1 | 4/2012 | Pan | |
| 2012/0098903 | A1 | 4/2012 | Xie | |
| 2013/0155135 | A1 | 6/2013 | Govyadinov | |
| 2013/0155152 | A1 | 6/2013 | Govyadinov et al. | |
| 2013/0182022 | A1 | 7/2013 | Strunk et al. | |
| 2015/0049141 | A1 | 2/2015 | Taff et al. | |

FOREIGN PATENT DOCUMENTS

| | | |
|---|---|---|
| WO | WO-2011146069 | 11/2011 |
| WO | WO-2011146145 | 11/2011 |
| WO | WO-2011146149 | 11/2011 |
| WO | WO-2011146156 | 11/2011 |
| WO | WO-2012008978 | 1/2012 |
| WO | WO-2012015397 | 2/2012 |
| WO | WO-2012057758 | 5/2012 |
| WO | WO-2012148412 | 11/2012 |

OTHER PUBLICATIONS

International Search Report for PCT/US2012/045439 dated Feb. 26, 2013.

* cited by examiner

FLUID EJECTION APPARATUS WITH FLUID SUPPLY FLOOR FILTER

CROSS-REFERENCE TO RELATED PATENT APPLICATIONS

The present application is a continuation application claiming priority under 35 USC Section 120 from co-pending U.S. patent application Ser. No. 14/928,357 filed on Oct. 30, 2015 by Govyadinov et al. and entitled FLUID EJECTION APPARATUS which claimed priority from U.S. patent application Ser. No. 14/397,481 filed on Oct. 27, 2014 by Govyadinov et al. and entitled FLUID EJECTION APPARATUS which claimed priority from PCT/US 12/45439 filed on Jul. 3, 2012 by Govyadinov et al. and entitled FLUID EJECTION APPARATUS, the full disclosures each of which are hereby incorporated by reference.

BACKGROUND

Some devices, such as printers, selectively eject fluid onto a print medium or substrate. Such devices may encounter performance problems due to entrapment of contaminating particles and air bubbles.

DETAILED DESCRIPTION OF EXAMPLES

Figure 1:
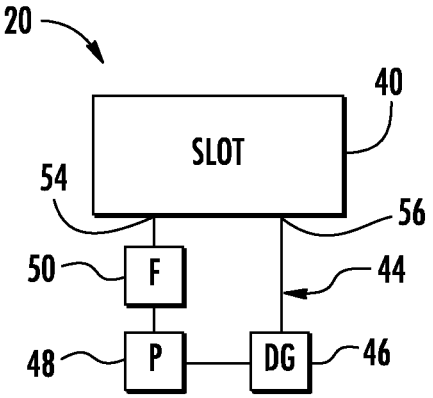
FIG. 1 is a schematic illustration of an example fluid ejection apparatus.

FIG. 1 schematically illustrates an example fluid ejection apparatus 20. Fluid ejection apparatus 20 ejects droplets of a liquid or fluid, such as ink, onto a print medium or substrate. As will be described hereafter, fluid ejection apparatus 20 ejects such droplets of fluid while experiencing fewer performance issues due to entrapment of contaminating particles and air bubbles. Fluid ejection apparatus 20 comprises fluid slot 40, passage 44, drop generator 46, fluid circulation pump 48 and filter 50.

Fluid slot 40 comprises a channel connected to a fluid source. Fluid slot 40 directs fluid from the fluid source to one or more drop generators 46. In one implementation, fluid slot 40 may extend between rows of drop generators 46. In another implementation, fluid slot 40 may extend over drop generators 46.

Passage 44, sometimes referred to as a recirculation channel, comprises a channel, lumen, tube or other structure extending from slot 40 to deliver fluid from slot 40 to drop generator 46. Passage 44 comprises an inlet 54 and an outlet 56. Inlet 54 is connected to slot 40 provides an opening through which fluid from slot 40 enters passage 44 and begins flowing within passage 44. Inlet 54 is located between slot 40 and pump 48.

Outlet 56 is spaced from inlet 54 so as to be independent of inlet 54. Outlet 56 is connected to slot 40 and provides an opening through which fluid may flow out of passage 44. In the example illustrated, passage 44 directs such fluid being discharged from passage 44 into slot 40.

Outlet 56 and inlet 54 cooperate to provide circulation of fluid across filter 50, across pump 48 and across drop generator 46 prior to being discharge from passage 44. In one implementation, such circulation is provided by a passage 44 that is U-shaped and that extends or is contained within a substantially horizontal plane, perpendicular to the direction in which fluid droplets are ejected by drop generator 46 and perpendicular to the direction in which nozzle openings of drop generator 46 face. In one implementation, the inlet 54 and the outlet 56 face in a direction perpendicular to the direction which the fluid droplets are attracted by drop generator 46. In another implementation, such circulation is provided by a passage 44 that is U-shaped and that extends or contained within a substantially vertical plane, parallel to the direction in which fluid droplets are ejected by drop generator 46 and parallel to the direction in which nozzle openings of drop generator 46 face. In one implementation, the inlet 54 and the outlet 56 face in a direction perpendicular to the direction which the fluid droplets are attracted by drop generator 46. Although illustrated as having a generally U shape, in other implementations, passage 44 may have a variety of other shapes with outlet 56 and inlet 54 being independent.

Drop generator 46 comprises a drop-on-demand device that is configured to generate individual droplets of liquid or fluid and to expel such droplets. In one implementation, drop generator 46 comprises an ejection element adjacent are proximate to a chamber and a nozzle or nozzle opening, wherein the ejection element comprises a device capable of operating to eject fluid drops through a corresponding nozzle. In one example, drop generator 46 comprises a thermoresistive drop-on-demand inkjet device, wherein the electrical current is selectively applied to the ejection element comprising a resistor (by, for example, a thin film transistor) that generates sufficient heat to vaporize liquid, creating a bubble that forcefully ejects remaining liquid within the chamber through a nozzle. In one implementation, the ejection element may comprise a thermoresistive ejection element which may employ a thermal resistor formed on an oxide layer on a top surface of a substrate and a thin film stack applied on top of the oxide layer, wherein the thin film stack includes a metal layer defining the ejection element, conductive traces and a passivation layer.

In another implementation, drop generator 46 comprises a piezoresistive drop-on-demand inkjet device, wherein electrical current is selectively applied to a piezoresistive member (by, for example, a thin film transistor) to deflect a diaphragm that forcefully ejects remaining liquid within the chamber through a nozzle. In yet other implementations, drop generator 46 may comprise other forms of presently available or future developed liquid drop generators. Drop generator 46 is generally located within passage 44 opposite to at least one nozzle opening and is further located between outlet 56 and pump 48.

Pump 48 comprises a device to pump or move fluid from inlet 54, to drop generator 46 and towards outlet 56. Pump 48 is located between filter 50 and drop generator 46 within passage 44. In one implementation, pump 48 is asymmetrically located with respect to a center point of a length of passage 44. The asymmetric location of pump 48 may create a short side of the passage 44 between pump 48 and fluid slot 40 and a long side of the passage 44 between pump 48 and outlet 56. The asymmetric location of pump 48 provides fluid diodicity within passage 44 that results in a net fluid flow in a forward direction towards the long side of passage 44 and towards outlet 56.

In one implementation, pump 48 comprises a pumping element, wherein the pumping element comprises a device capable of operating to move liquid or fluid through and along passage 44. In one implementation, the pumping element may be similar to the ejection element found in drop generator 46. In one example, the pumping element may comprise a thermoresistive pumping element which may employ a thermal resistor formed on an oxide layer on a top surface of a substrate and a thin film stack applied on top of the oxide layer, wherein the thin film stack includes a metal layer defining the pumping element, conductive traces and a passivation layer. In another example, the pumping element may comprise a piezoresistive pumping element, wherein electrical current is selectively applied to a piezoresistive member (by, for example, a field effect transistor (FET) to deflect a diaphragm that forcefully pumps fluid along passage 44 towards outlet 56 and towards drop generator 46. In yet other implementations, pump 48 may comprise other forms of pumps such as electrostatic pump, and electrohydrodynamic pump and the like.

Filter 50 comprises a structure configured to conduct fluid while also restraining particles in the fluid from reaching drop generator 46. Filter 50 extends across inlet 54 or across portions of passage 44 between slot 40 and pump 48. Filter 50 comprises a mesh assembly that defines a plurality of apertures openings through which fluid form a flow, but wherein the apertures or openings are sufficiently small to restrict flow of contaminants or particles there through. In one implementation, filter 50 comprises a 6-10 micron filter when employed with ink. In other implementations, filter 50 may have other densities, such as looser or tighter meshes.

Figure 2:
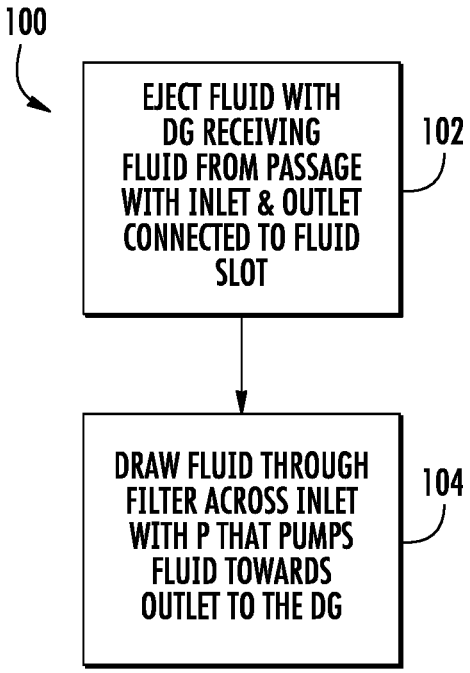
FIG. 2 is a flow diagram of an example method that may be carried out by the apparatus of FIG. 1.

FIG. 2 is a flow diagram illustrating an example method 100 which may be carried out by fluid ejection apparatus 20 of FIG. 1. As indicated by step 102, in response to a command from a controller, fluid is ejected onto a substrate print medium by drop generator 46. Drop generator 46 receives a fluid from passage 44 which has an inlet 54 and an outlet 56 connected to fluid slot 40.

As indicated by step 104, the ejected fluid or liquid is replenished by apparatus 20. In particular, fluid is drawn from slot 40 through and across filter 50 by pump 48. The fluid drawn into passage 44 by pump 48 is further pumped towards outlet 56 to drop generator 46. In one implementation, the pump is activated within a time after the ejection of the droplet by drop generator 46 such that a majority of the ejected fluid within the chamber opposite to drop generator 46 is replenished by fluid that has been drawn through filter 50 immediately following the ejection of the fluid drop. In one example, the pump is actuated within the time after the ejection of the droplet by drop generator 46 such that all of the ejected fluid within the chamber opposite to or adjacent to drop generator 46 is replaced completely by fluid that is been drawn through filter 50.

In one example, pump 48 is actuated a single time to complete such replenishment. In other examples, pump 48 may be actuated multiple times so as to sufficiently replenish the fluid that has been consumed or expelled during the drop ejection. In one example, pump 48 is actuated within at least 50 milli-seconds (ms) following the ejection of a drop by drop generator 46, nominally within at least 20 ms, and nominally about 2 ms following the ejection of a drop by drop generator 46. In other implementations, depending upon the configuration of passage 44, the size of the droplets ejected by drop generator 46, and the filtering density of filter 50, as well other factors, the timing at which pump 48 is fired or activated following the ejection the drop may vary.

Because the fluid is drawn through filter 50 prior to being ejected by drop generator 46, apparatus 20 reduces the introduction of external contaminants and air bubbles that might otherwise be pulled into the nozzle such as when ejected fluid is replenished or such as during priming or wiping. At the same time, because pump 48 circulates fluid across drop generator 46 back to slot 40, trapped contaminants and air bubbles adjacent to drop generator 46 are expelled prior to the next drop generation cycle. As a result, the occurrence of nozzle failure is reduced and printing performance is enhanced. Recirculation should be on after priming or wiping to flush any particles.

Figure 3:
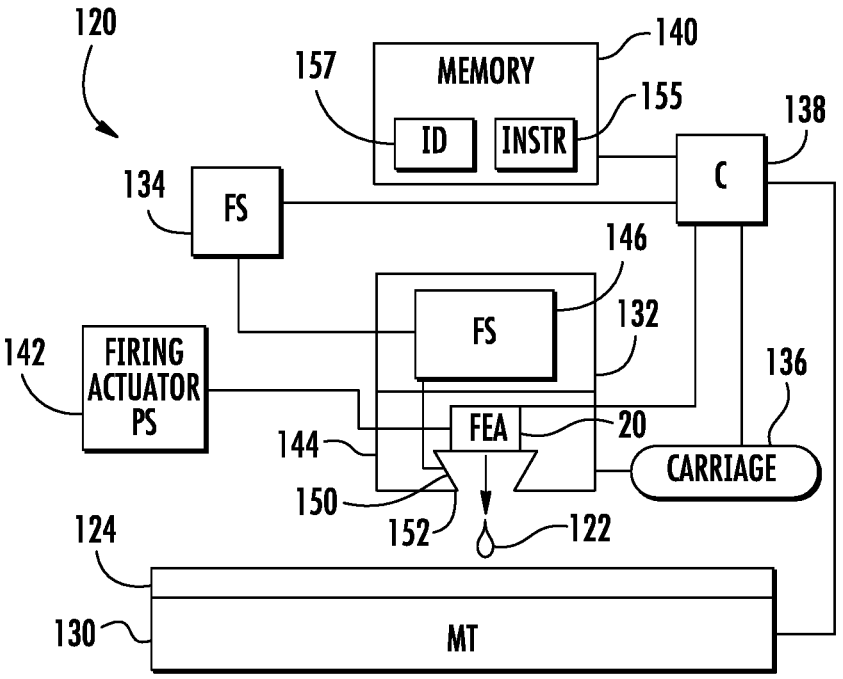
FIG. 3 is a schematic illustration of an example printing system including the example fluid ejection apparatus of FIG. 1.

FIG. 3 schematically illustrates an example printing system 120 which incorporates fluid ejection apparatus 20. Printing system 120 is configured to selectively deliver drops 122 of fluid or liquid onto a print media 124. Printing system 120 utilizes drop-on-demand inkjet technology. Printing system 120 comprises media transport 130, print head assembly or printing unit 132, fluid supply 134, carriage 136, controller 138, memory 140 and inkjet firing actuator power supply system 142. Media transport 130 comprises a mechanism configured to transport or move print media 124 relative to print unit 132. In one example, print media 124 may comprise a web. In another example, print media 124 may comprise individual sheets. In one example to print media 124 may comprise a cellulose-based material, such as paper. In another example print media 124 may comprise other materials upon which ink or other liquids are deposited. In one example, media transport 130 may comprise a series of rollers and a platen configured to support media 124 as the liquid is deposited upon the print media 124. In another example, media transport 130 may comprise a drum upon which media 124 is supported as the liquid is deposited upon medium 124.

Print unit 132 ejects droplets 122 onto a media 124. Although one unit 132 is illustrated for ease of illustration, printing system 120 may include a multitude of print units 132. Each print unit 132 comprises print head 144 and fluid supply 146. Print head 144 comprises one or more chambers 150, one or more nozzles 52 and fluid ejection apparatus 20 (described above). Each chamber 150 comprises a volume of fluid connected to supply 146 to receive fluid from supply 146. Each chamber 150 is located between and associated with one or more nozzles 52 and fluid ejection apparatus 20. The one or more nozzles 152 each comprise small openings through which fluid or liquid is ejected onto print media 124.

Fluid supply 146 comprises an on-board volume, container or reservoir containing fluid in close proximity with print head 144. Fluid supply 134 comprises a remote or off axis volume, container or reservoir of fluid which is supplied to fluid supply 146 through one or more fluid conduits. In some examples, fluid supply 134 may be omitted, wherein entire supply of liquid or fluid for print head 144 is provided by fluid reservoir 146. For example, in some examples, print unit 132 may comprise a print cartridge which is replaceable or refillable when fluid from supply 146 has been exhausted.

Carriage 136 comprise a mechanism configured to linearly translate or scan print unit 132 relative to print medium 124 and media transport 130. In some examples where print unit 132 spans media transport 130 and media 124, such as with a page wide array printer, carriage 136 may be omitted.

Controller 138 comprises one or more processing units configured to generate control signals directing the operation of media transport 130, fluid supply 134, carriage 136 and actuator 154 of print head 144. For purposes of this application, the term "processing unit" shall mean a presently developed or future developed processing unit that executes sequences of instructions contained in memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other examples, hard wired circuitry may be used in place of or in combination with software instructions to implement the functions described. For example, controller 138 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example illustrated, controller 138 carries out or follows instructions 155 contained in memory 140. In operation, controller 138 generates control signals to fluid supply 134 to ensure that fluid supply 146 has sufficient fluid for printing. In those examples in which fluid supply 134 is omitted, such control steps are also omitted. To effectuate printing based upon image data 157 at least temporarily stored in memory 140, controller 138 generates control signals directing media transport 130 to position media 124 relative to print unit 132. Controller 138 also generates control signals causing carriage 136 to scan print unit 132 back and forth across print media 124. In those examples in which print unit 132 sufficiently spans media 124 (such as with a page wide array), control of carriage 136 by controller 138 may be omitted. To deposit fluid onto medium 124, controller 138 generates control signals carrying out of method 100 of FIG. 2 for selected nozzles 152 to eject or fire liquid onto media 124 to form the image according to image data 157.

Figure 4:
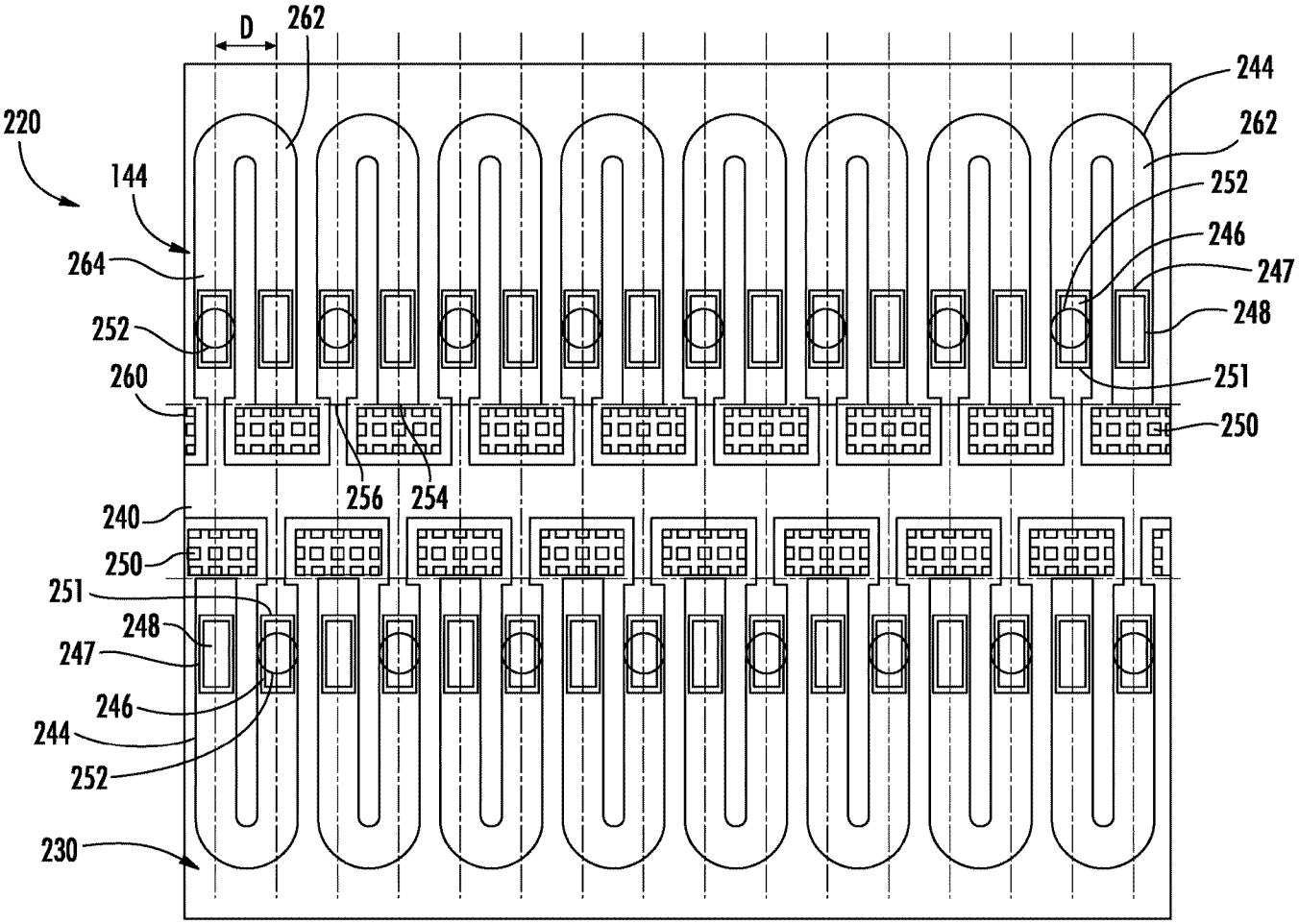
FIG. 4 is a bottom sectional view of an example of the fluid ejection apparatus of FIG. 1.

FIG. 4 is a bottom sectional view of fluid ejection apparatus 220, a particular example of fluid ejection apparatus 20. Apparatus 220 is formed as part of a print head 144 and comprises die or substrate 230, slot 240, passages 244, drop generators 246, pump wells 247, pumps 248, filters 250, chambers 251, nozzles 252 and constrictions 260. Substrate 230 comprise a structure serving as a foundation for the remaining components of apparatus 220. Substrate 230 forms slot 240 which is connected to a fluid source, such as fluid source 146 shown in FIG. 3. Substrate 230 further forms a shelf 260 on each side of slot 240, wherein the shelf forms or includes the remaining components of apparatus 220. In one implementation, substrate 230 may be formed from silicon while those portions of shelf 264 forming passages 244 may be formed from an epoxy-based negative photoresist such as SU8. In other implementations, substrate 230 and shelf 264 may be formed from other materials.

Passages 244 each comprises a channel, lumen, tube or other structure extending from slot 240 to deliver fluid from slot 240 to drop generator 246. Passage 244 comprises an inlet 254 and an outlet 256. Inlet 254 is connected to slot 240 provides an opening through which fluid from slot 240 enters passage 244 and begins flowing within passage 244. Inlet 254 is located between slot 240 and pump 248.

Outlet 256 is spaced from inlet 254 so as to be independent of inlet 254. Outlet 256 is connected to slot 240 and provides an opening through which fluid may flow out of passage 244. In the example illustrated, passage 244 directs such fluid being discharged from passage 244 into slot 240.

Outlet 256 and inlet 254 cooperate to provide circulation of fluid across filter 250, across pump 248 and across drop generator 246 prior to being discharge from passage 244. In the example illustrated, passage 244 is U-shaped and extends or is contained within a substantially horizontal plane, perpendicular to the direction in which fluid droplets are ejected by drop generator 246 and perpendicular to the direction in which nozzle openings of drop generator 46 face. Passage 244 includes a first portion 262 containing pump 248 and a second portion or leg 264 containing drop generator 246. In one implementation, the centerline of portions 262 and 264 are spaced by a distance D of 42 μm, 28 μm or 21 μm to provide either 600, 900 or 1200 nozzles per linear inch, respectively. In other implementations, portions 262 and 264 may have other pitches.

Chambers 251 comprise cavities formed as part of passage 244, along the main or central portion of passage 244. Chambers 251 extend between nozzles 252 and drop generators 246. Nozzles 252 comprise openings through which the fluid or liquid is ejected.

Drop generator 246 comprises a drop-on-demand device that is configured to generate individual droplets of liquid or fluid and to expel such droplets. In one implementation, drop generator 246 comprises an ejection element enclosed by a chamber 251 and a nozzle 252, wherein the ejection element comprises a device capable of operating to eject fluid drops through the corresponding nozzle 252. In one example, drop generator 246 comprises a thermoresistive drop-on-demand inkjet device, wherein the electrical current is selectively applied to the ejection element comprising a resistor (by, for example, a thin film transistor) that generates sufficient heat to vaporize liquid, creating a bubble that forcefully ejects remaining liquid within the chamber through a nozzle. In one implementation, the ejection element may comprise a thermoresistive ejection element which may employ a thermal resistor formed on an oxide layer on a top surface of a substrate and a thin film stack applied on top of the oxide layer, wherein the thin film stack includes a metal layer defining the ejection element, conductive traces and a passivation layer.

In another implementation, drop generator 246 comprises a piezoresistive drop-on-demand inkjet device, wherein electrical current is selectively applied to a piezoresistive member (by, for example, a thin film transistor) to deflect a diaphragm that forcefully ejects remaining liquid within the chamber through a nozzle. In yet other implementations, drop generator 246 may comprise other forms of presently available or future developed liquid drop generators. Drop generator 246 is generally located within passage 244 opposite to at least one nozzle opening 252 and is further located between outlet 256 and pump 248.

Pump well 247 comprises a cavity, depression or volume adjacent to and along a main portion passage 244. Pump well 247 is sized to receive pump 248. In other implementations, pump well 247 may be omitted, producing a "flat" or even protruded pump 248.

Pump 248 comprises a device to pump or move fluid from inlet 254, to drop generator 246 and towards outlet 256. Pump 248 is located between filter 250 and drop generator 246 within passage 244. In the example illustrated, pump 248 is asymmetrically located with respect to a center point of a length of passage 244. The asymmetric location of pump 248 creates a short side of the passage 244 between pump 248 and fluid slot 240 and a long side of the passage 244 between pump 248 and outlet 256. The asymmetric location of pump 248 provides fluid diodicity within passage 244 that results in a net fluid flow in a forward direction towards the long side of passage 44 and towards outlet 256.

In one implementation, pump 248 comprises a pumping element, wherein the pumping element comprises a device capable of operating to move liquid or fluid through and along passage 244. In one implementation, the pumping element may be similar to the ejection element found in drop generator 246. In one example, the pumping element may comprise a thermoresistive pumping element which may employ a thermal resistor formed on an oxide layer on a top surface of a substrate and a thin film stack applied on top of the oxide layer, wherein the thin film stack includes a metal layer defining the pumping element, conductive traces and a passivation layer. In another example, the pumping element may comprise a piezoresistive pumping element, wherein electrical current is selectively applied to a piezoresistive member (by, for example, a thin film transistor) to deflect a diaphragm that forcefully pumps fluid along passage 244 towards outlet 56 and towards drop generator 246. In yet other implementations, pump 248 may comprise other forms of pumps such as electrostatic pump, and electro-hydrodynamic pump and the like.

Filter 250 comprises a structure configured to conduct fluid will also restraining particles in the fluid from reaching drop generator 246. Filter 250 extends across inlet 254 or across portions of passage 244 between slot 240 and pump 248. Filter 250 comprises a mesh assembly that defines a plurality of apertures openings through which fluid form a flow, but wherein the apertures or openings are sufficiently small to restrict flow of contaminants or particles there through. In one implementation, filter 250 comprises a 6-10 micron filter when employed with ink. In other implementations, filter 50 may have other densities, such as looser or tighter meshes.

Constrictions 260 each comprise a narrowing portion of fluid passage 244 at or near outlet 256. Each constriction 260 serves as a drop ejection and fluidic frequency tuning feature/knob. Constrictions 260 further reduce or make it more difficult for fluid within slot 240 to reenter passage 244 as the fluid within chamber 247 is being replenished after firing and ejection of liquid by drop generator 246. Constrictions 260 also constrict the flow of contaminants and air bubbles into passage 240 through outlet 256 during such liquid or fluid replenishment. At the same time, such constrictions 260 are sufficiently large to allow air bubbles to be pumped, under positive pressure provided by pumps 248, out of passage 244 and into slot 240. In the example illustrated, passage 244 has a cross sectional area of between 100×50 $\mu m^2$ and 5×9 $\mu m^2$ between constrictions 260. In other implementations, the cross sectional area may vary even beyond this range. In such implementations, the cross sectional area is limited by nozzle density per linear inch or nozzle pitch. For typical 17/20 μm stack and 1200 nozzle per linear inch, the cross sectional area is in range 28×21 and 5×17 $\mu m^2$. In the example illustrated, outer walls or portions of filter 250 encroach upon an project partially across outlet 256 to constrict outlet 256. In other implementations, constrictions 260 may be provided by other formed structures.

Figure 5:
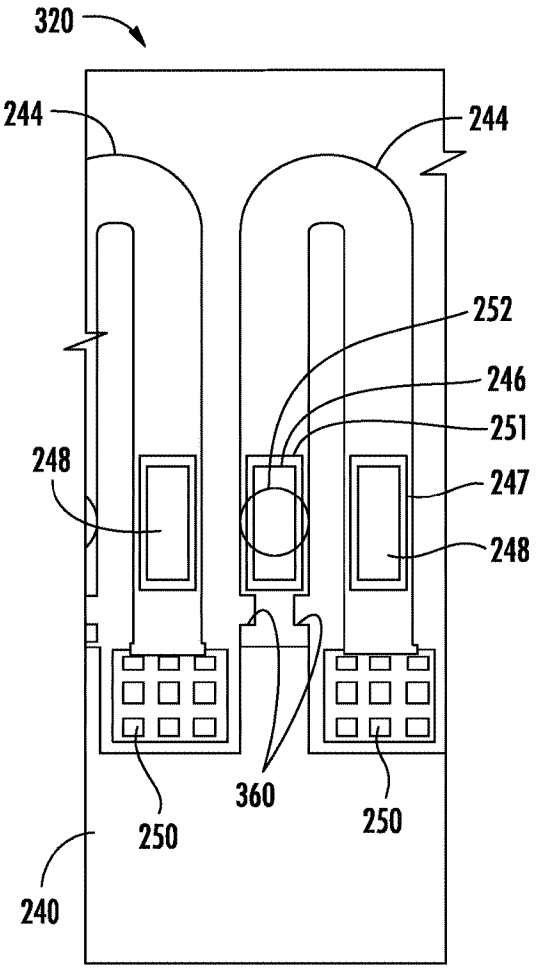
FIG. 5 is a bottom sectional view of another example of the fluid ejection apparatus of FIG. 1.

FIG. 5 illustrates fluid ejection apparatus 320, another example of fluid ejection apparatus 20. Fluid ejection apparatus 320 is similar to fluid ejection apparatus 220 except that fluid ejection apparatus 320 comprises pinch constrictions 360 instead of constrictions 260. Those remaining components of fluid ejection apparatus 320 which correspond to components of fluid ejection apparatus 220 are numbered similarly. Pinch constrictions 360 comprise structures within each of passages 244. As with constrictions 260, constrictions 360 constrict the flow of contaminants and air bubbles into chambers 247 through outlet 256 during such liquid or fluid replenishment. At the same time, such restrictions sufficiently large to allow air bubbles to be pumped, under positive pressure provided by pumps 248, out of passage 244 and into slot 240. In the example illustrated, passage 244 has a cross sectional area of between 100×50 $\mu m^2$ and 5×9 $\mu m^2$ between constrictions 360. In some implementations, the cross sectional area may vary even beyond this range, wherein the cross sectional area one is limited by nozzle density per linear inch or nozzle pitch. For typical 17/20 μm SU-8 stack, this specific example ranges from 28×21 to 5×17 $\mu m^2$.

Figure 6:
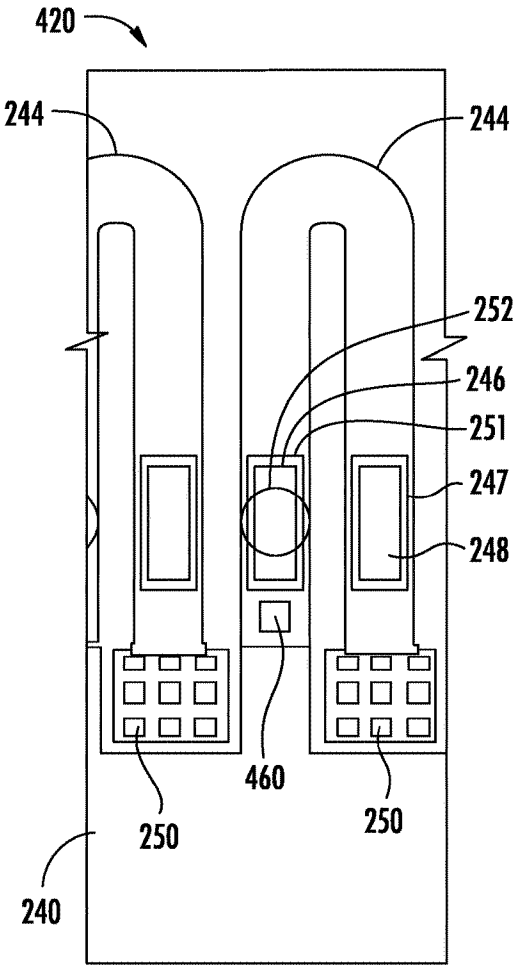
FIG. 6 is a bottom sectional view of another example of the fluid ejection apparatus of FIG. 1.

FIG. 6 illustrates fluid ejection apparatus 420, another example of fluid ejection apparatus 20. Fluid ejection apparatus 420 is similar to fluid ejection apparatus 220 except that fluid ejection apparatus 320 comprises of flow obstructions 460 instead of constrictions 260. Those remaining components of fluid ejection apparatus 420 which correspond to components of fluid ejection apparatus 220 are numbered similarly. Flow obstructions 460 comprise structures, such as posts or columns within each of passages 244. As with constrictions 260, flow obstructions 460 constrict the flow of contaminants and air bubbles into chambers 247 through outlet 256 during such liquid or fluid replenishment. At the same time, such obstructions 460 are sufficiently large to allow air bubbles to be pumped, under positive pressure provided by pumps 248, out of passage 244 and into slot 240. In the example illustrated, passage 244 has a cross sectional area of between 40×50 $\mu m^2$ and 5×9 $\mu m^2$ about each obstruction 460. For 17/20 μm stack example and 1200 nozzle per linear inch, the cross sectional area is in range 10×21 and 5×17 $\mu m^2$.

Figure 7:
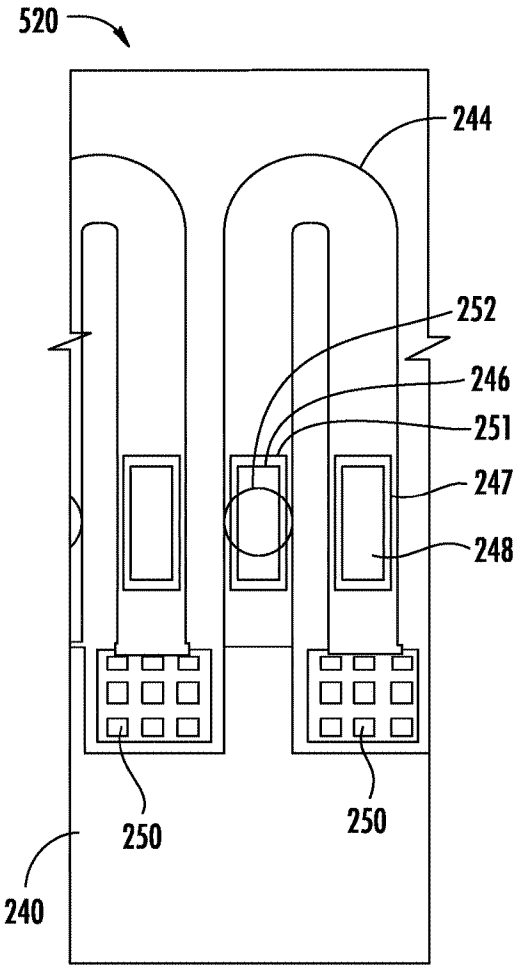
FIG. 7 is a bottom sectional view of another example of the fluid ejection apparatus of FIG. 1.

FIG. 7 illustrates fluid ejection apparatus 520, another example of fluid ejection apparatus 20. Fluid ejection apparatus 520 is similar to fluid ejection apparatus 220 except that fluid ejection apparatus 520 omits any constriction or obstruction proximate to outlet 256 of passage 244. Those remaining components of fluid ejection apparatus 420 which correspond to components of fluid ejection apparatus 220 are numbered similarly.

Figure 8:
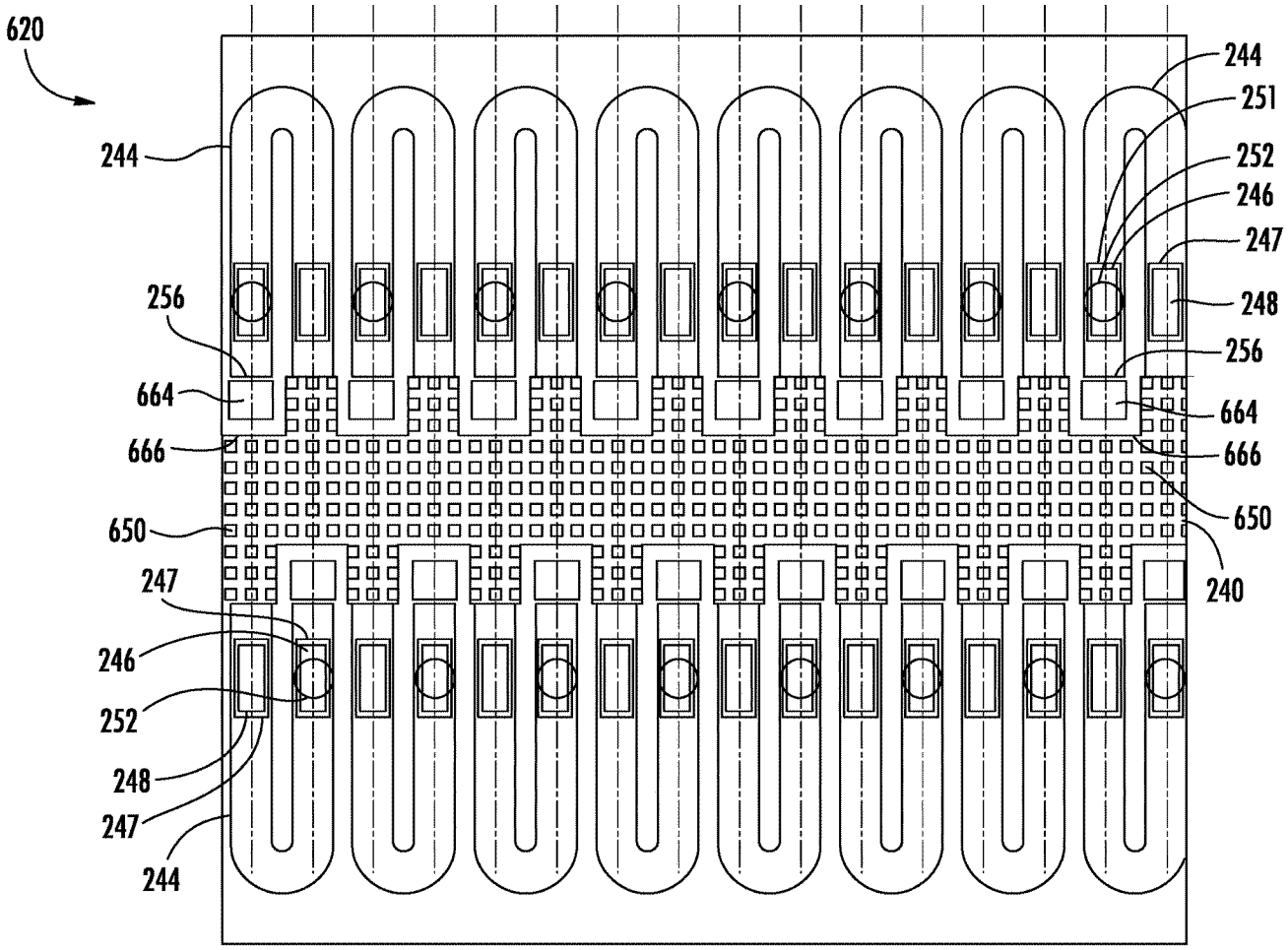
FIG. 8 is a bottom sectional view of another example of the fluid ejection apparatus of FIG. 1.

FIG. 8 is a bottom view illustrating fluid ejection apparatus 620, another example implementation of fluid ejection apparatus 20. Fluid ejection apparatus 620 is similar to fluid ejection apparatus 520 except that apparatus 620 comprises filter 650 and fluid discharge openings or holes 664 in place of filters 250. Those remaining components of apparatus 620 which correspond to components of apparatus 520 are numbered similarly.

Filter 650 is similar to filter 250 except that filter 650 continuously extends across the inlets 254 of multiple fluid passages 244 on at least one side of slot 240. In the illustrated example, filter 650 continuously extends across the inlets 254 of multiple fluid passages 244 on both sides of slot 240. In the example illustrated, filter 250 continuously extends across slot 240 from one side of slot 240 to the other side of slot 240. Because filter 650 continuously extends across the inlets 254 of multiple fluid passages 244, fabrication of filter 650 for multiple passages 244 is facilitated.

Figure 11:
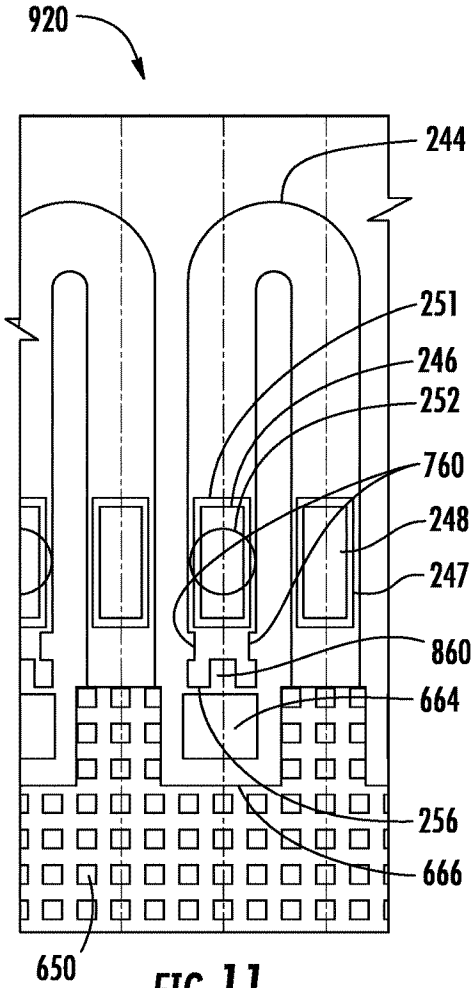
FIG. 11 is a bottom sectional view of another example of the fluid ejection apparatus of FIG. 1.
Figure 10:
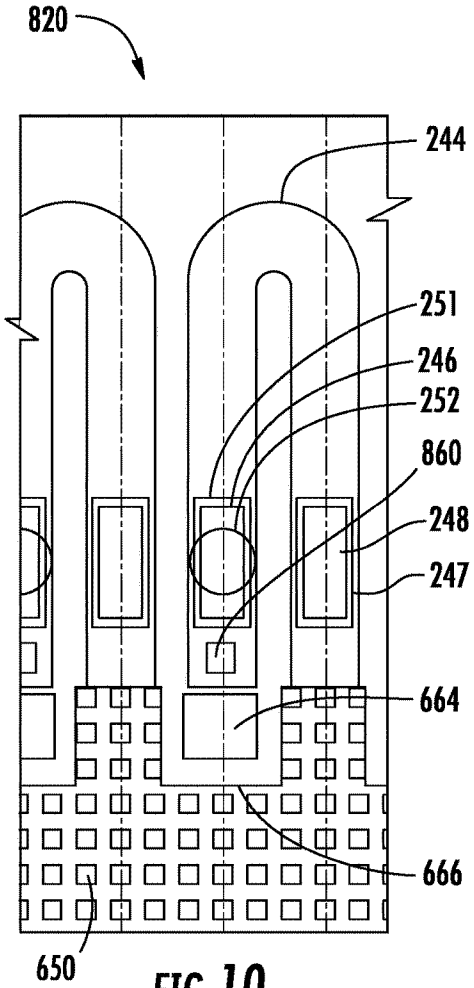
FIG. 10 is a bottom sectional view of another example of the fluid ejection apparatus of FIG. 1.
Figure 9:
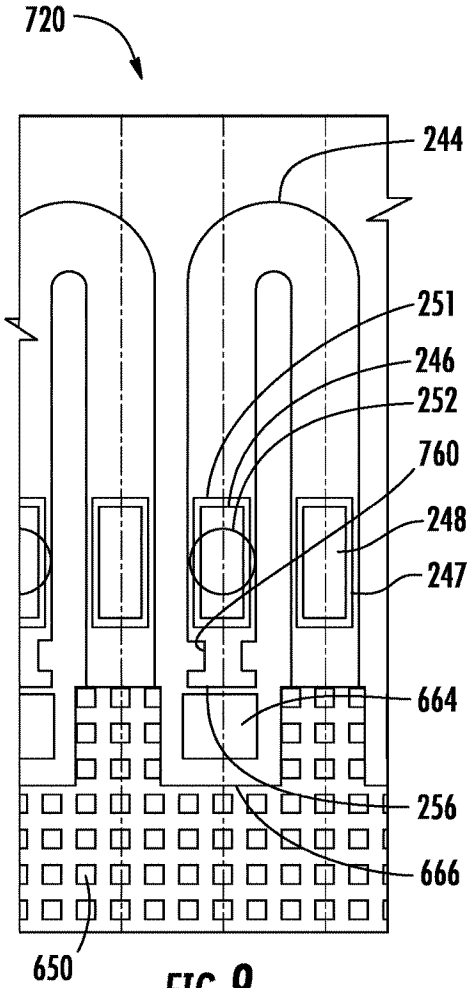
FIG. 9 is a bottom sectional view of another example of the fluid ejection apparatus of FIG. 1.

Discharge holes 664 comprise individual openings within filter 650 to the adjacent each outlet 256. Such discharge holes 664 reduce likelihood that air will become entrapped within passage 244. In the example illustrated, such discharge holes 664 are further separated from filter 650 by a cage or wall 666 which reduces chances for contaminates or particles being drawn into or occluding outlet 256. Although illustrated as omitting any constrictions or obstructions, in other implementations, apparatus 620 may additionally include one or more of constrictions 260, 360 or obstructions 460, or combinations thereof, as described above and illustrated in fluid ejection apparatuses 720, 820 and 920 in FIGS. 9-11, respectively.

Figure 14:
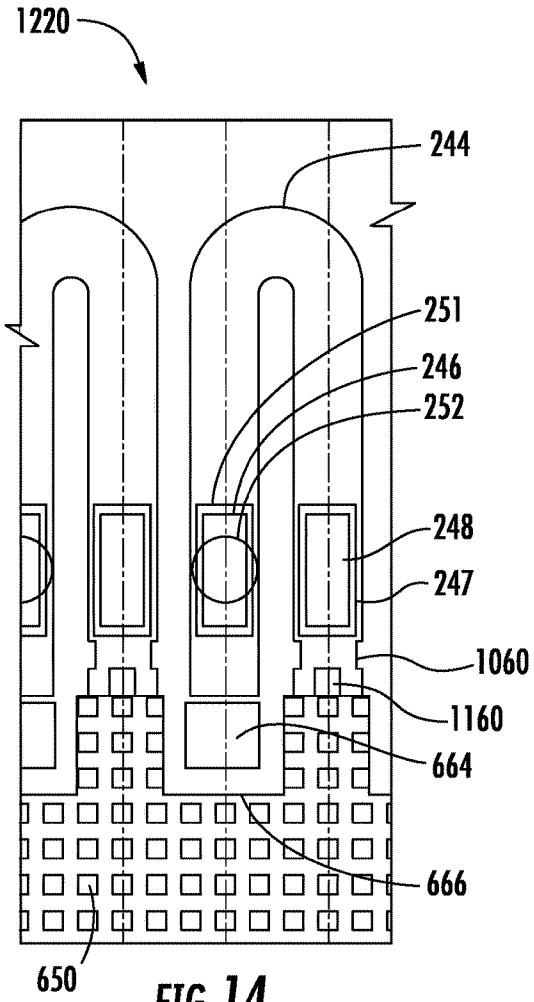
FIG. 14 is a bottom sectional view of another example of the fluid ejection apparatus of FIG. 1.
Figure 13:
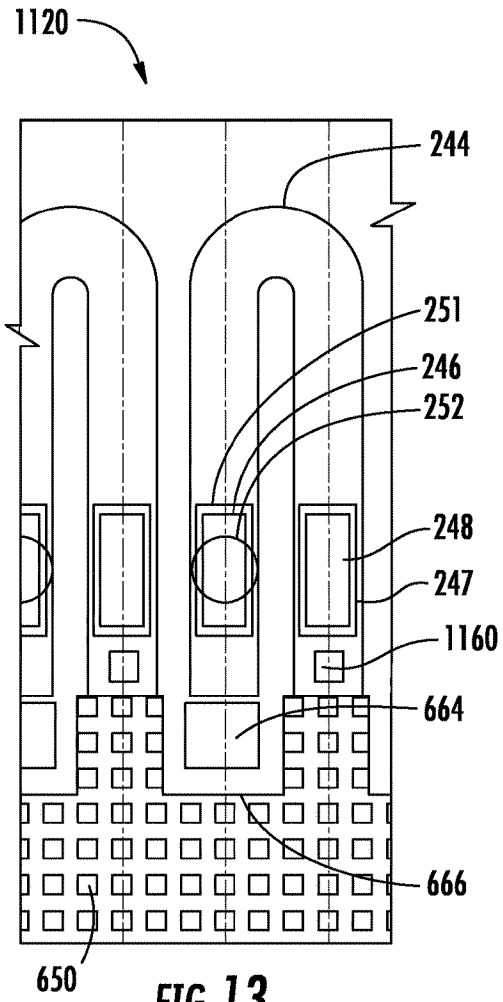
FIG. 13 is a bottom sectional view of another example of the fluid ejection apparatus of FIG. 1.
Figure 12:
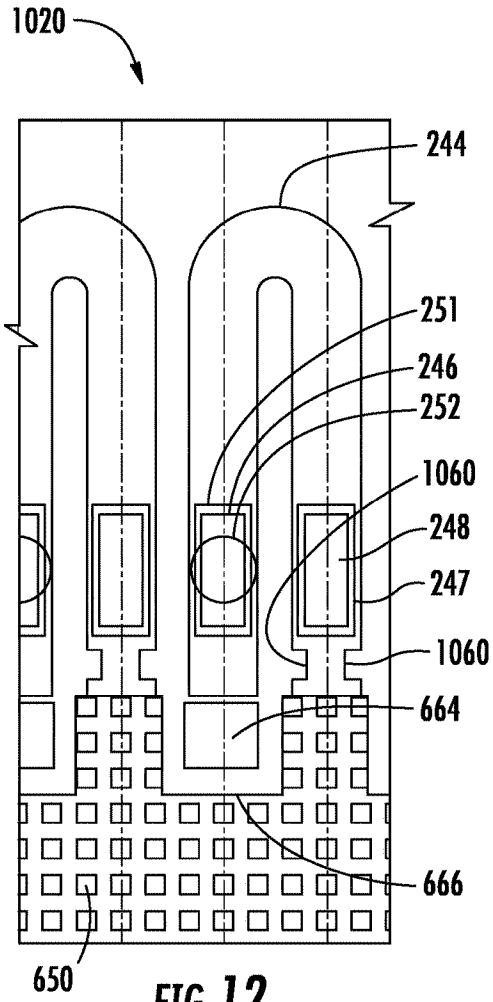
FIG. 12 is a bottom sectional view of another example of the fluid ejection apparatus of FIG. 1.

FIGS. 12-14 illustrate fluid ejection apparatuses 1020, 1120 and 1220, respectively. Apparatuses 1020, 1120 and 1220 are identical to apparatus 620 except that apparatuses 1020, 1120 and 1220 additionally include constrictions or obstructions between pump 248 and inlet 254 to reduce or mitigate introduction of air bubbles into passage 244 from slot 240. Such pinch constrictions or obstructions are similar to pinch constrictions 360 and flow obstructions 460 described above except that such constrictions or obstructions are located within passage 244 between pump 248 and inlet 254. Apparatus 1020 of FIG. 12 includes pinch constrictions 1060 within passage 244 between pump 248 and inlet 254. In the example illustrated, passage 244 has a cross sectional area of between 100×50_and 5×9 $\mu m^2$ between constrictions 1060. Apparatus 1120 of FIG. 13 includes flow obstructions 1160 within passage 244 between pump 248 and inlet 254. In the example illustrated, passage 244 has a cross sectional area of between 40×50 and 5×9 $\mu m^2$ about obstructions 1160. Apparatus 1220 of FIG. 14 includes both pinch constrictions 1060 and flow obstructions 1160. In the example illustrated, passage 244 has a cross sectional area of between 40×50 and 5×8 $\mu m^2$ between constrictions 1060 and obstructions 1160. In other implementations, such constrictions and obstructions may have other configurations.

Figure 15:
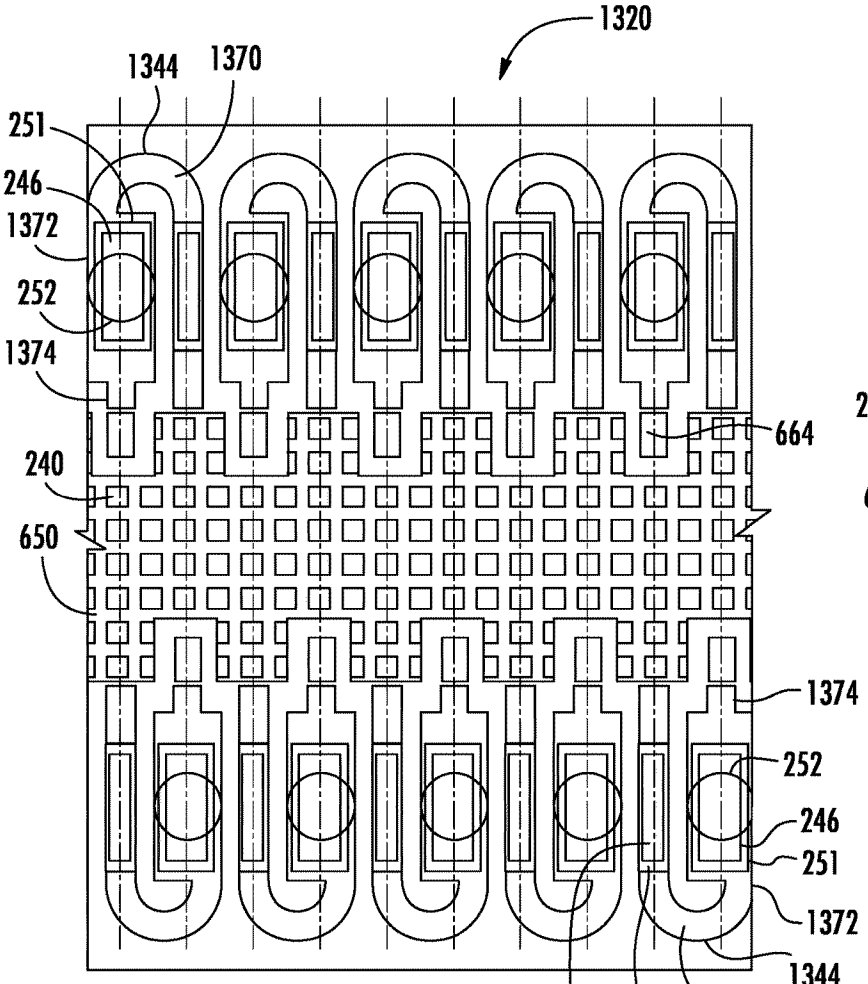
FIG. 15 is a bottom sectional view of another example of the fluid ejection apparatus of FIG. 1.

FIG. 15 is a bottom sectional view of fluid ejection apparatus 1320, another example of fluid ejection apparatus 20. Fluid ejection apparatus 1320 is identical to fluid ejection apparatus 620 except that fluid ejection apparatus 1320 comprises passages 1344 in place of passages 244. Those remaining components of apparatus 1320 which correspond to components of apparatus 620 are numbered similarly. Although not illustrated, in other implementations, fluid ejection apparatus 1320 may additionally include one or more of the above described constrictions 260, 360, 1060 or flow obstructions 460, 1160.

Fluid passage 1344 is similar to passage 244 except that fluid passage 1344 comprises portions 1370, 1372 and outlet constrictions 1374. Portion 1370 extends from inlet 254 to portion 1372 and contains pump 248. Section 1344 can connect to portion 1372 in multiple locations, eg, centered on section 1372 or offset from the center. Portion 1370 has a smaller width and smaller cross-sectional area as compared to portion 1372. Portion 1372, which has a larger cross-sectional area and larger width, extends from portion 1370 to outlet 256. Portion 1372 extends opposite to nozzle 252 and contains drop generator 246. Because portion 1370 has a cross sectional area and width less than the cross-sectional area and width of portion 1372 containing drop generator 246, drop generator 246 may be relatively larger providing faster drop generation and ejection while portion 1370 of passage 1344 is smaller, inhibiting passage of contaminants and air bubbles therethrough.

Outlet constrictions 1374 constrict a size of outlet 256 such that outlet 256 has a smaller cross-sectional area and with as compared to portion 1372. As a result, air or contaminants particles are less likely be drawn back into passage 1344 during replenishment of fluid after fluid ejection. In the example illustrated, outlet constrictions 1374 are formed by the walls or cage 666. In other implementations, constrictions 1374 may be formed by other structures or may be omitted.

Figure 16:
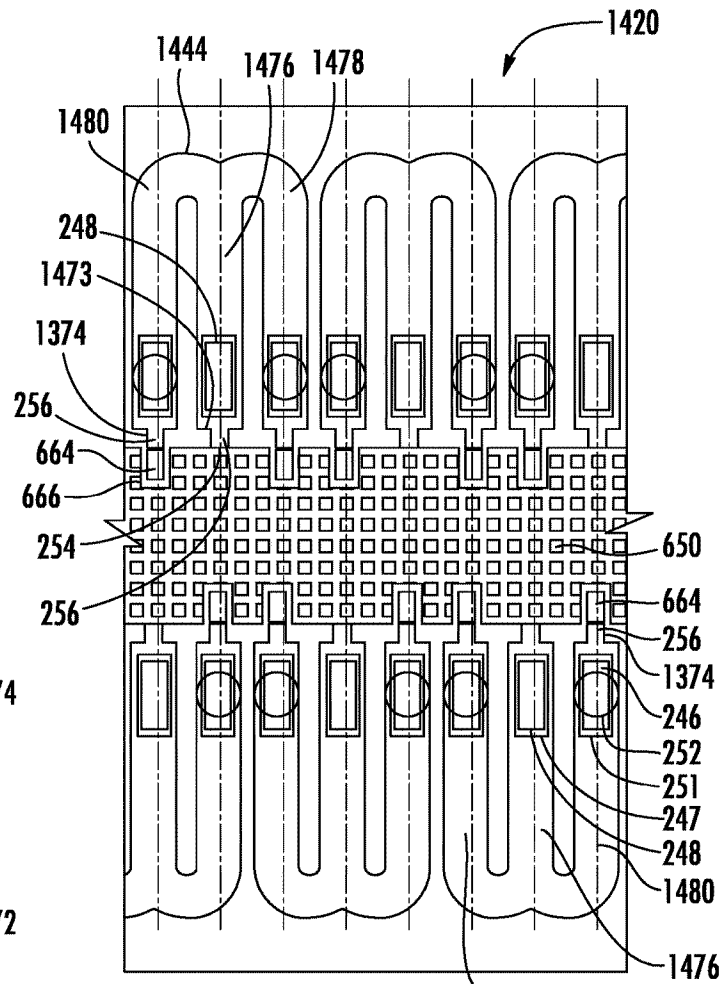
FIG. 16 is a bottom sectional view of another example of the fluid ejection apparatus of FIG. 1

FIG. 16 is a bottom sectional view of fluid ejection apparatus 1420, another example of fluid ejection apparatus 20. Fluid ejection apparatus 1420 is identical to fluid ejection apparatus 620 except that fluid ejection apparatus 1420 includes non-uniformly or not equally distributed nozzles 252. As shown by FIG. 16, fluid ejection apparatus 1420 is similar to apparatus 620 except that apparatus 1420 comprises passages 1444 in place of passages 244, inlet constrictions 1473 and outlet constrictions 1374. Those remaining components of apparatus 1420 which correspond to components of apparatus 620 are numbered similarly. Although not illustrated, in other implementations, fluid ejection apparatus 1420 may additionally include one or more of the above described constrictions 260, 360, 1060 or flow obstructions 460, 1160.

Fluid passage 1444 is similar to passage 244 except that fluid passage 1444 comprises portions 1476, 1478 and 1480. Portion 1476 extends from inlet 254, sandwiched between portions 1478 and 1480. Portion 1476 branches off and merges into each of portions 1478 and 1480. Portion 1476 contains pump 248 and feeds or directs fluid from inlet 254 to each of portions 1478 and 1480.

Inlet constrictions 1473 constrict a size of inlet 254 such that inlet 254 has a smaller cross-sectional area and width as compared to portion 1476. As a result, air or contaminants particles are less likely be drawn back into passage 1444 during replenishment of fluid after fluid ejection. In the example illustrated, inlet constrictions 1473 are formed by the walls separating portion 1476 from portions 1478 and 1480. In other implementations, constrictions 1473 may be formed by other structures or may be omitted.

Portions 1478 and 1480 each extend from portion 1476. Portion 1478 extends to a first one of outlets 256 while portion 1480 extends to a second one of outlets 256. Each of the first and second outlets 256 opens into a fluid discharge opening 664 formed by cage 666 and within filter 650. Each of portions 1478 and 1480 extends across and opposite to a nozzle 252 and contains a drop generator 246 opposite to an associated nozzle 252. Each of outlets 256 is further provided with an outlet constriction 1374 (described above). With the example apparatus 1420, fluid may be pumped and supplied to two drop generators 246 by a single pump 248.

Figure 17:
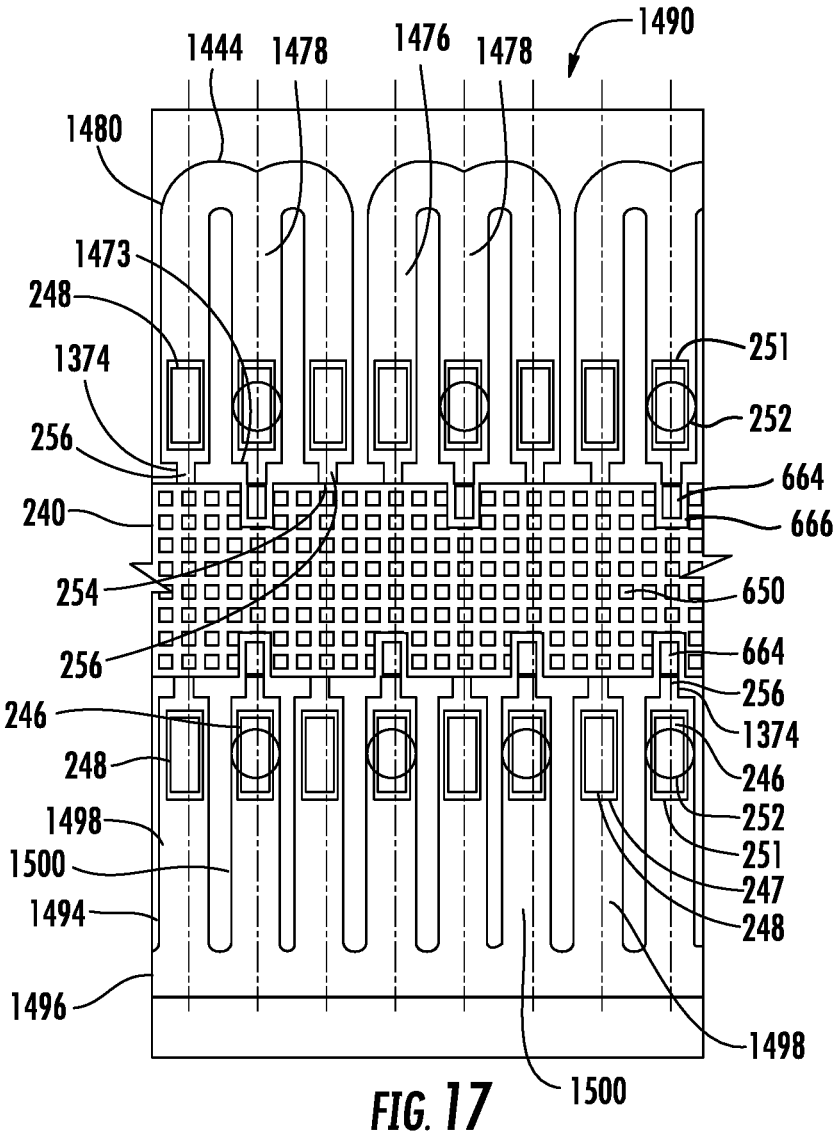
FIG. 17 is a bottom sectional view of another example of the fluid ejection apparatus of FIG. 1.

In other implementations, other combinations of drop generators and pumps may be utilized. FIG. 17 illustrates fluid ejection apparatus 1490 which illustrates two alternative example combinations or architectures. As shown by FIG. 17, the top half of fluid ejection apparatus 1490, above slot 240, is similar to the top half of fluid ejection apparatus 1420 except that instead of a single pump 248 supplying liquid to two drop generators 246, the top half of apparatus 1490 utilizes two pumps 248 for pumping or driving liquid to and across a single drop generator 246. Liquid is drawn through each of inlets 256 through portions 1478, 1480 of passage 1444 and through portions 50 and 78 to drop generator 246. Although FIG. 17 illustrates two pumps 248 supplying fluid to a single drop generator 246, in other implementations, passage 1444 may have other configurations and greater than two pumps 248 may be provided for supplying fluid to single drop generator 246. In yet other implementations, passage 1444 may be reconfigured to connect a plurality of pumps 248 to a plurality of drop generators 246, wherein the number of pumps 240 is greater than the number of drop generators 246 in one implementation or wherein the number of drop generator 246 is greater than the number of pumps, 248 in another implementation.

The bottom half of fluid ejection apparatus 1490 illustrates an example architecture including passage 1494 in place of passage 1444. Passage 1494 comprises a single main portion 1496 from which portions 1498 and 1500 extend toward slots 240. Portion 1498 include pumps 248 while portion 1500 include drop generators 246. As a result, the plurality of pumps 48 supply liquid to a plurality of drop generators 246.

Although each of the portions of branches 1444 and 1494 have been illustrated as including a single pump 248 or a single drop generator 246, in some implementations, a single branch or portion may contain more than one pump 248 or more than one drop generator 246. In other implementations, apparatus 1420 may include independent filters such as filters 250 described above instead of the single continuous filter 650. In other implementations, portion 1476 may have a smaller width or cross-sectional area as compared to portions 1478, 1480 similar to the configuration of apparatus 1320.

Figures 18A, 18B, 18C, 18D, 18E, 18F, 18G, 18H:
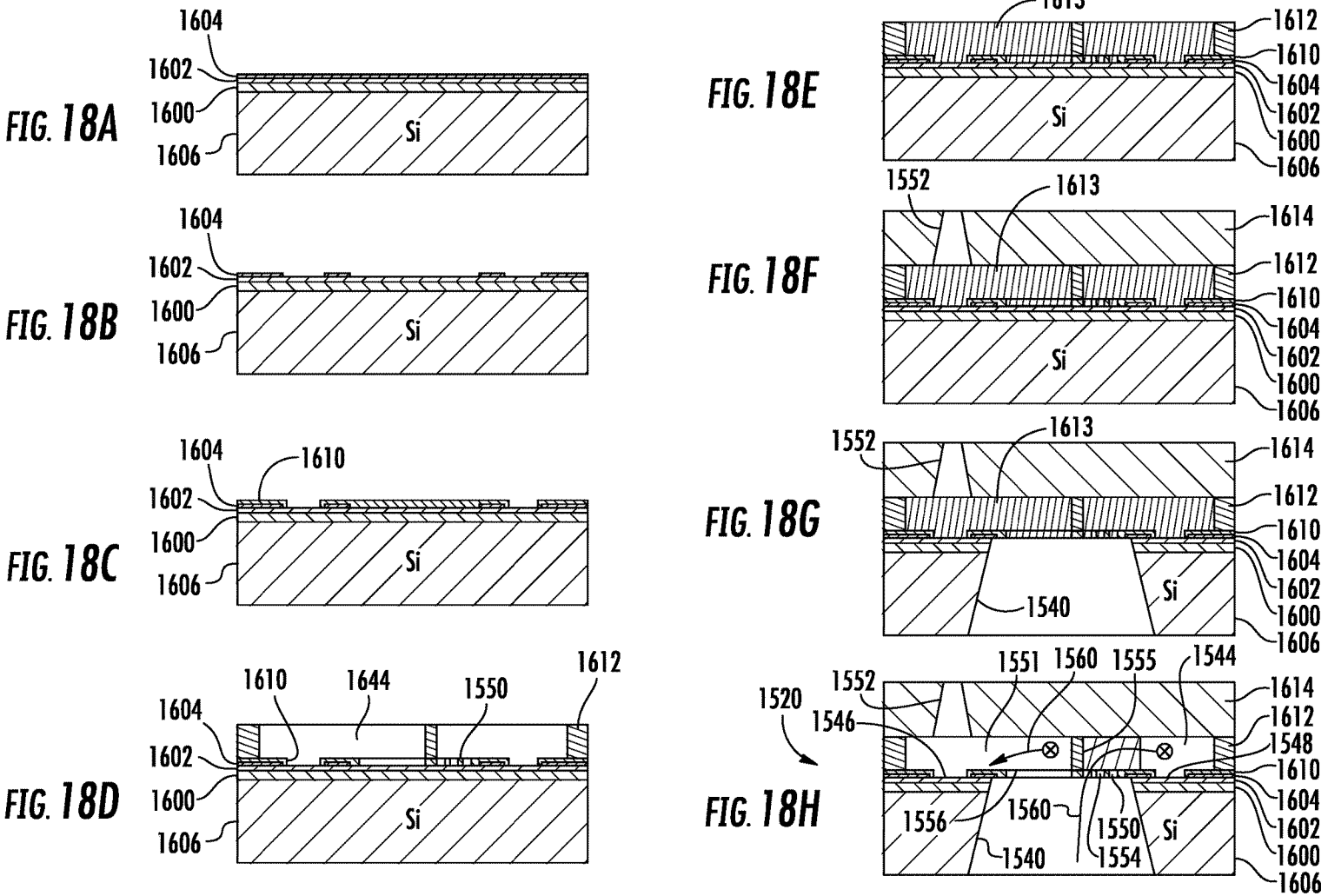
FIGS. 18A-18H are sectional views illustrating an example method for forming an example fluid ejection apparatus shown in FIG. 18H.

FIGS. 18A-18H are sectional views illustrating one example method for forming an example fluid ejection apparatus 1520 (shown in FIG. 18H). As shown by FIG. 18A, a complementary metal-oxide-semiconductor (CMOS) layer 1600, a thin-film stack 1602 and a passivation layer 1604 are deposited upon a dielectric substrate 1606, such as silicon. As shown in FIG. 18B, conductive traces, resistor areas, passivation and anti-cavitation layers are then patterned. As shown by FIG. 18C, a patterned primer layer 1610 is deposited upon the passivation layer 1604. As shown by FIG. 18D, the patterned primer layer 1610 is further patterned to define filter 1550. Thereafter, chamber layer 1612 is deposited in pattern to form passage 1544. As shown by FIG. 18E, a wax fill 1613 and chemical mechanical planarization (CMP) are carried out. As shown by FIG. 18F, bore layer 1614 is formed upon chamber layer 1612. Bore layer 1614 defines nozzle 1552. As shown by FIG. 18G, substrate 1606, CMOS layer 1600, thin-film stack 1602 and passivation layer 1604 are etched to form slot 1640.

Lastly, as shown by FIG. 18H, the wax fill is removed to form fluid ejection apparatus 1520. Fluid ejection apparatus 1520 comprises fluid slot 1540, passage 1544, drop generator 1546, pump 1548 and filter 1550. Fluid slot 1540, passage 1544, drop generator 1546, pump 1548 and filter 1550 correspond to fluid slot 40, passage 44, drop generator 46, pump 48 and filter 50 described above with respect to FIG. 1. In use, after the firing or ejection of fluid through nozzle 1552, the ejected fluid within the cavity 1551 is replenished with fluid, such as ink, that is drawn by pump 1548 from slot 1540 through filter 1550 and pumped within passage 1544 around chamber wall 1555 (into the page and subsequently out of the page as indicated by the circled crosses) to drop generator 1546 as indicated by arrow 1560.

Figure 19:
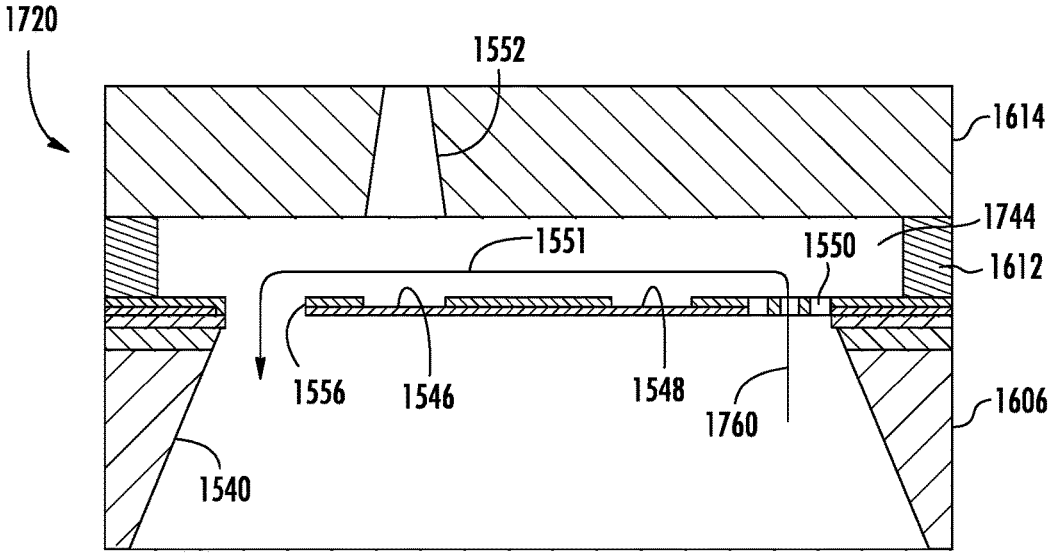
FIG. 19 is a sectional view of another example fluid ejection apparatus.
Figure 20:
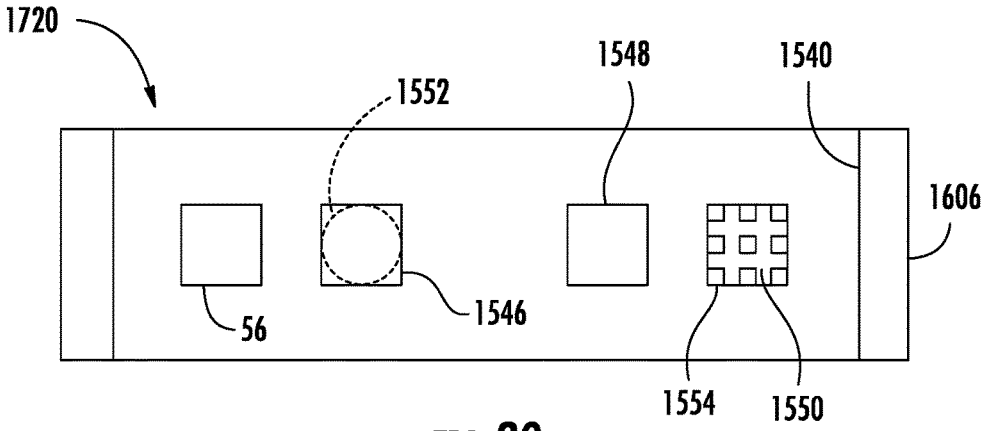
FIG. 20 is a bottom view of the fluid ejection apparatus of FIG. 19.

FIGS. 19 and 20 illustrate fluid ejection apparatus 1720, another example implementation of fluid ejection apparatus 20. Fluid ejection apparatus 1720 is similar to fluid ejection apparatus 1520 in both its manufacture and architecture except that fluid ejection apparatus 1720 utilizes a straight or linear fluid passage 1744 in place of the U-shaped passage 1544. Those remaining components of fluid ejection apparatus 1720 which correspond to components of fluid ejection apparatus 1520 are numbered similarly. As indicated by arrow 1760, after the firing or ejection of fluid through nozzle 1552, the ejected fluid within the cavity 1551 (opposite to nozzle 1552) is replenished with fluid, such as ink, that is drawn by pump 1548 from slot 1540 through inlet 1554, through filter 1550 and pumped within passage 1544 in a linear direction parallel to a line connecting filter 1550 and outlet 1556 and perpendicular to the direction in which nozzle 1552 faces to drop generator 1546.

Figure 21:
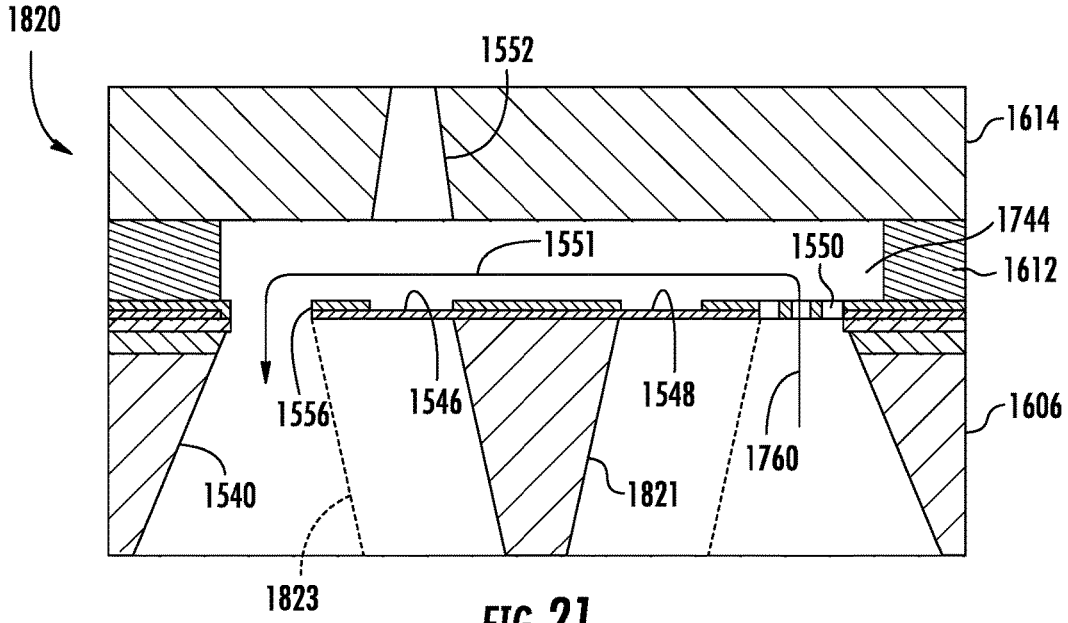
FIG. 21 is a sectional view of another example fluid ejection apparatus.
Figure 22:
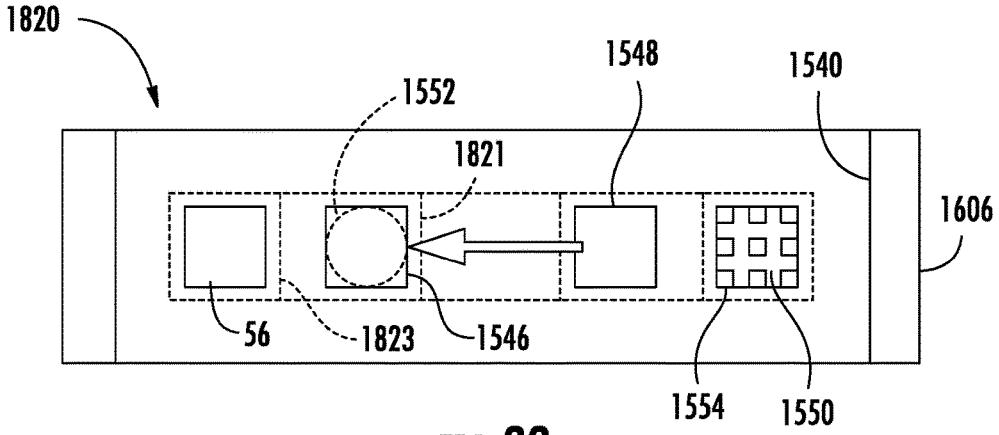
FIG. 22 is a bottom view of the fluid ejection apparatus of FIG. 21.

FIGS. 21 and 22 illustrate fluid ejection apparatus 1820, another example implementation of fluid ejection apparatus 20. Fluid ejection apparatus 1820 is similar to fluid ejection apparatus 1720 except that fluid ejection apparatus 1820 additionally comprises silicon support 1821. Support 1821 comprises a post or rib within slot 1548 connected to the layers forming pump 1548 and drop generator 1546. Support 1821 extends between pump 1548 and drop generator 1546, wherein the layers forming drop generator 1546 and pump 1548 extend outwardly beyond support 1821. In one implementation, support 1821 is formed out of the layer of material forming substrate 1606.

As indicated by broken lines, in another implementation, fluid ejection apparatus 1820 may alternatively comprise a silicon ridge or divider 1823 in place of support 1821. Divider 1823 extends within slot 1540 between filter 1550 and outlet 1556. Divider 1823 is similar to support 1821, but additionally underlies (or overlies depending upon the orientation) the layers forming drop generator 1546 and pump 1548. In one implementation, divider 1823 is formed out of the layer of material forming substrate 1606.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A fluid ejection apparatus comprising:

a fluid supply channel;

a drop generator vertically below and horizontally offset from the fluid supply channel;

a filter below the fluid supply channel and forming a floor of the fluid supply channel, wherein the filter extends between the fluid supply channel and the drop generator such that fluid is to flow in a vertical direction into the floor of the fluid supply channel and horizontally to the drop generator; and a passage having an inlet to receive fluid that is passed through the filter and an outlet spaced from the inlet and connected to the fluid supply channel, the passage having a first portion extending in a first direction from the inlet and a second portion extending from the first portion to the outlet in a second direction, opposite to the first direction, the drop generator being located along the second portion of the passage.

2. The fluid ejection apparatus of claim 1 further comprising:

a fluid circulation pump along the first portion of the passage between the drop generator and the inlet, wherein the filter extends across the inlet.

3. The apparatus of claim 2 further comprising a flow constriction between the drop generator and the outlet.

4. The apparatus of claim 2 further comprising a flow obstruction within the passage and surrounded by the passage between the drop generator and the outlet.

5. The apparatus of claim 2 further comprising:

a second passage having a second inlet connected to the fluid supply channel and a second outlet spaced from the second inlet and connected to the fluid supply channel;

a second drop generator along the passage;

a second fluid circulation pump, wherein the filter continuously extends across the inlet and the second inlet and wherein the outlet and the second outlet each have a corresponding opening in the filter.

6. The apparatus of claim 2, further comprising:

a second inlet for the passage and connected to the fluid supply channel;

a second drop generator along the passage; and a second fluid circulation pump between the second drop generator and the second inlet.

7. The apparatus of claim 2, further comprising:

a second inlet for the passage and connected to the fluid supply channel; and a second fluid circulation pump between the drop generator and the second inlet.

8. The apparatus of claim 2 further comprising a flow constriction between the fluid circulation pump and the inlet.

9. The apparatus of claim 8 further comprising an obstruction within and surrounded by the passage between the pump and the inlet.

10. The apparatus of claim 2 further comprising an obstruction within and surrounded by the passage between the pump and the inlet.

11. The apparatus of claim 2, wherein the second portion has a first cross-sectional area adjacent the drop generator and extending to the outlet and wherein the first portion has a second cross-sectional area less than the first cross-sectional area and extending from the drop generator to the inlet.

12. The apparatus of claim 2, wherein the passage comprises a third portion extending from the first portion to a second outlet connected to the fluid supply channel, wherein the apparatus further comprises a second fluid drop generator within the third portion.

13. The apparatus of claim 2, wherein the drop generator eject drops in a first direction and wherein the inlet faces in a second direction substantially perpendicular to the first direction.

14. The apparatus of claim 2, wherein the drop generator is spaced from the fluid supply channel by a distance and wherein the fluid circulation pump is spaced from the fluid supply channel by the distance.

15. The apparatus of claim 2, wherein the filter continuously extends from the inlet to and across the outlet.

16. The apparatus of claim 2 further comprising a discharge hole within the filter adjacent the outlet.

17. The apparatus of claim 2, wherein the inlet and the outlet are side-by-side along the fluid slot.

18. The apparatus of claim 2 further comprising:

a second passage having a second inlet connected to the fluid slot and a second outlet spaced from the second inlet and connected to the fluid slot, the second inlet and the second outlet located on a side of the fluid supply channel opposite to the inlet and the outlet;

a second drop generator along the second passage;

a second fluid circulation pump between the second drop generator and the second inlet, wherein the filter continuously extends within the fluid supply channel across the first inlet and across the second inlet.

19. A method comprising:

supplying fluid from a fluid supply;

circulating a first portion of the fluid vertically through a filter that forms a floor of the fluid supply into a fluid passage and then horizontally along the fluid passage past a drop generator back to the fluid supply; and drawing a second portion of the fluid vertically through the filter and then from the fluid passage by ejecting the second portion of the fluid with the drop generator.

20. The method of claim 19, wherein the fluid supply passage extends in a first direction from the fluid supply and returns to the fluid supply in a second direction, opposite the first direction.

* * * * *